US007950402B1

(12) United States Patent
Cole

(10) Patent No.: US 7,950,402 B1
(45) Date of Patent: May 31, 2011

(54) CONTOURED EYE SHADOW APPLICATOR SYSTEM AND MAKE-UP METHOD

(76) Inventor: Christina M. Cole, Falls Church, VA (US)

( * ) Notice: Subject to any disclaimer, the term of this patent is extended or adjusted under 35 U.S.C. 154(b) by 1284 days.

(21) Appl. No.: 11/139,785

(22) Filed: May 31, 2005

(51) Int. Cl.
*A45D 40/26* (2006.01)

(52) U.S. Cl. ..... 132/320

(58) Field of Classification Search ..... 132/317, 132/318, 218, 293, 313, 320, 216; 15/60, 15/DIG. 5; 401/9, 11
See application file for complete search history.

(56) References Cited

U.S. PATENT DOCUMENTS 4,998,315 A * 3/1991 Pessis ..... 15/160
5,137,038 A * 8/1992 Kingsford ..... 132/218
5,375,288 A * 12/1994 Seagren ..... 15/169
5,765,573 A * 6/1998 Gueret ..... 132/218
6,026,824 A * 2/2000 Gueret ..... 132/218
6,073,634 A * 6/2000 Gueret ..... 132/218
6,220,254 B1 * 4/2001 Gueret ..... 132/313
6,450,178 B1 * 9/2002 Clay ..... 132/218
6,779,532 B2 * 8/2004 Dorf ..... 132/200
D527,143 S * 8/2006 Fischer ..... D28/7
2002/0083953 A1 * 7/2002 Dorf ..... 132/200
2004/0134002 A1 * 7/2004 Zimmer ..... 15/28
2004/0237996 A1 * 12/2004 Fischer et al. ..... 132/320

* cited by examiner

*Primary Examiner* — Rachel R Steitz

(57) ABSTRACT

An applicator system for applying eye shadow is provided that includes flexible body, which may be a bundle of bristles, having a proximal end secured to a handle, and a distal end having a concave shape that is substantially complementary to a portion of a closed eye lid. The concave shape is asymmetrical so that one end of the bristle bundle extends farther out than the other end to facilitate the application of make-up under the brow region and in the corners of the eye area. Eye make-up is preferably applied to the concave brush by a convex-shaped pad of eye shadow in the shape of a cylindrical section having a convex profile that is complementary in shape to the concave profile of the distal end of the bristle bundle.

2 Claims, 4 Drawing Sheets

CONTOURED EYE SHADOW APPLICATOR SYSTEM AND MAKE-UP METHOD

FIELD OF THE INVENTION

This invention generally relates to make-up applicators, and is specifically concerned with an applicator for applying eye shadow whose working end is in a concave shape that is substantially complementary to the shape of a closed eye lid.

Eye shadow applicators are well known in the prior art. Such applicators include brushes having either a rounded or angular end, or sponge pads having a convex, rounded profile. In use, eye shadow is first applied to the applicator end of the brush or sponge by wiping the same across a pad of selected eye shadow make-up. The user then applies the eye shadow present on the end of the bristles or sponge to the area over the eye lid and beneath the eye brow.

While presently known eye shadow applicators are generally effective for their intended purpose, the applicant has observed a number of shortcomings in the structure and operation of such prior art applicators in which substantial improvement may be possible. For example, the applicant has observed that, as a result of the convex or angular shape of the ends of such applicators, they do not easily apply eye shadow uniformly over the eye lid and the rounded surfaces between the eye lid and the eye brow without a substantial number of strokes and care on the part of the user. A convex, rounded sponge pad applicator is particularly difficult to utilize, as it fails to distribute eye shadow uniformly over the rounded surfaces of the eye region due to the point or line contact such applicators make with such rounded surfaces. The end result is that the user must spend an inordinate amount of time and effort to get the intended coverage over the closed eye lid and brow region. Because of the necessity of numerous wipings of such applicators to the pad of eye shadow make-up and numerous strokes between the applicator and the user, they often become worn down quickly and sometimes disconnect from their handles, requiring replacement.

Brushes with rounded or angular profiles, while often more mechanically robust than sponge applicators, have the same shortcomings with respect to a non-uniform application of eye shadow, and the necessity of a large number of wiping strokes between the make-up pad and the user in order to achieve the intended effect. While brushes having angled profiles are somewhat better in applying eye shadow in the corners of the eye region, they too apply eye shadow make-up non-uniformly along the rounded surface of a closed eyelid. In all cases, the need for multiple rubbings of such applicators into the pad of relatively expensive eye shadow make-up, and multiple strokes before the desired application of make-up has taken place around the eye area, results in a pre-mature wearing down of the pad of eye shadow make-up, and large amounts of time, effort, and concentration on the part or the user to achieve a uniform application of eye shadow over the eye region.

Clearly, what is needed is an eye shadow applicator which is capable of efficiently and uniformly applying eye shadow to the rounded contours of the eye lid and under brow quickly, easily, and with a minimum number of strokes. Ideally, such an applicator should be both comfortable and robust, and capable of uniformly and quickly receiving an amount of eye shadow from a pad of such make-up after only a few rubbing strokes, and uniformly dispensing the make-up drawn onto its working end onto the desired areas. Finally, it would be desirable if such an applicator were relatively simple and easy to manufacture, and formed from conventional, relatively inexpensive materials.

SUMMARY OF THE INVENTION

Generally speaking, the invention is an applicator system for applying eye shadow that over comes or at least ameliorates all the aforementioned shortcomings associated with the prior art. To this end, the applicator system of the invention comprises a resilient body which is preferably a bundle of bristles having a proximal end secured to a handle, and a distal end having a concave shape that is substantially complementary in shape to a portion of a closed eye lid. In the preferred embodiment, the distal end of the applicator is elongated, having a substantially greater length than width, and the length and shape of the periphery of the concave end of the brush is approximately 50% of the maximum length of a vertical arc defined by a typical closed eye lid. Such proportioning allows the applicator to quickly and accurately apply a uniform film of eye shadow not only in the larger, centrally-located areas around the eyes, but also in the smaller areas between the corners of the eyes and the ends of the eye brows. Preferably also, the concave, arcuate shape is asymmetrical with respect to a length of the bristles forming the bundle such that one end of the bristle bundle is longer than the other end, giving it a shape roughly similar to an old-fashioned fountain-pen. The bristles forming the longest end of the bristle bundles are preferably stiffer than the bristles forming the rest of the bundle. The combination of such an asymmetry in the concave shape of the bristle bundle and stiffer bristles at one end provides a forward pointed portion of the brush that is particularly useful in applying eye shadow under the eye brow and in the corners of the eyes. While a bundle of bristles is the preferred manner of implementing the invention, a sponge body having a concave working end that is complementary in shape to a portion of a closed eye lid is also within the scope of the invention. The system of the invention may also include a pad of make-up having a convex outer surface that is complementary in shape the concave end of the applicator. In the preferred embodiment, the make-up pad is shaped like a section of a cylinder that has been truncated parallel to its axis of rotation. Such a combination allows make-up to be applied uniformly along the concave profile of the applicator. Finally, the invention encompasses a method of applying make-up with the aforementioned system that includes the steps of applying make-up to the distal end of the applicator, orienting the length of the end of the applicator vertically, applying eye shadow to a first portion of the eye region with lateral strokes across the region, rotating the applicator 180°, and applying eye shadow to a second region of the eye region with lateral strokes across the region.

DETAILED DESCRIPTION OF THE PREFERRED EMBODIMENT

Figure 1:
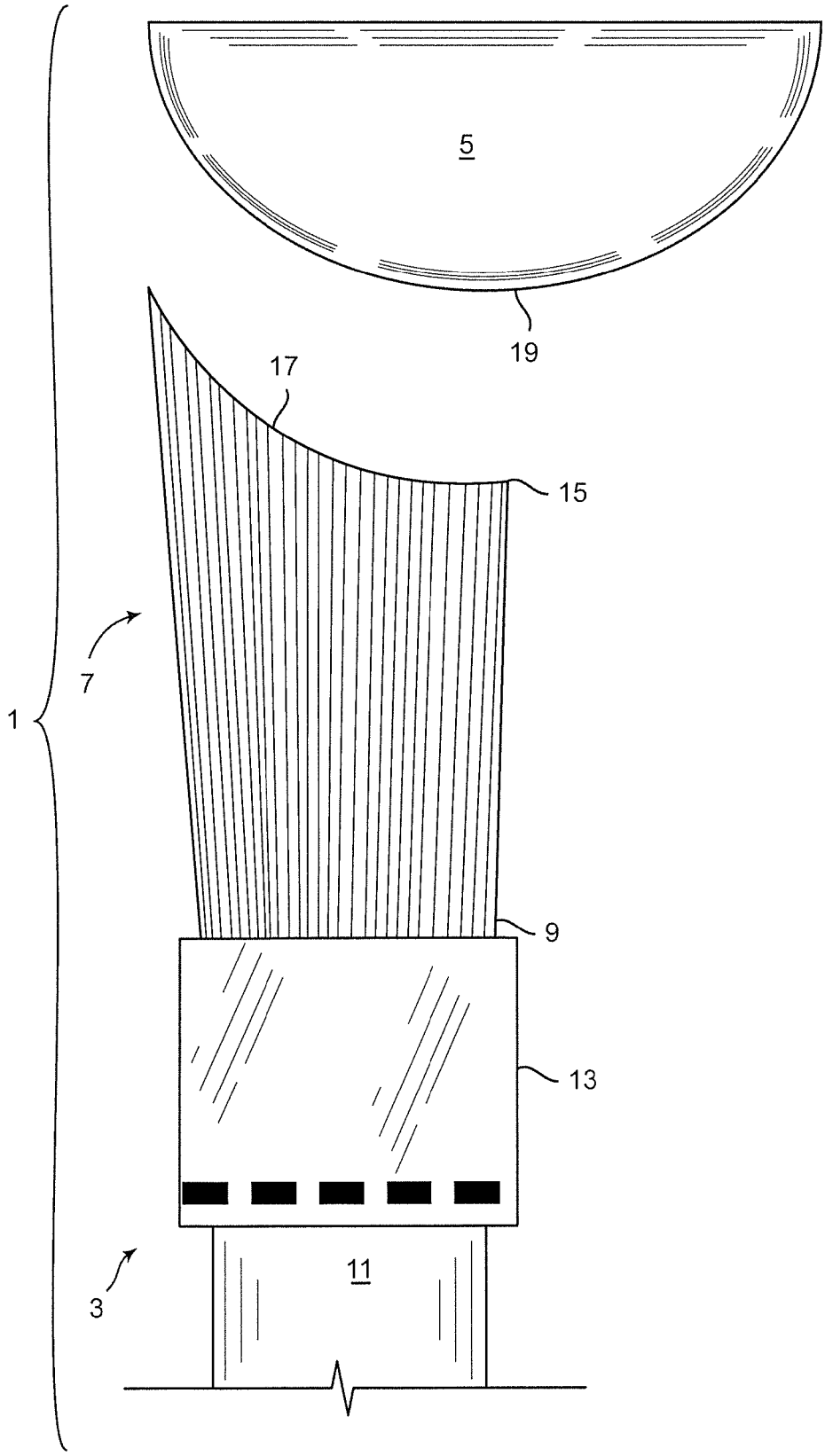
FIG. 1 is a side view of the eye shadow applicator system of the invention, illustrating both the applicator and the convex pad of eye shadow make-up that constitutes the system.

With reference to FIG. 1, wherein like numerals designate like components throughout all the several figures, the eye shadow applicator system 1 of the invention comprises an applicator 3 in combination with a convex pad 5 of eye shadow make-up. The applicator 3 includes a resilient body which may take the form of a sponge pad (not shown) or a bundle of bristles 7. The proximal end 9 of the bundle of bristles 7 is connected to a handle 11 by means of a collar member 13. The distal end 15 of the bundle of bristles 7 has a concave shape 17 which is not only complementary to the outer surface 19 of the convex pad 5 of eye shadow make-up, but is also complementary in shape to the closed eye lid of a user.

Figure 2:
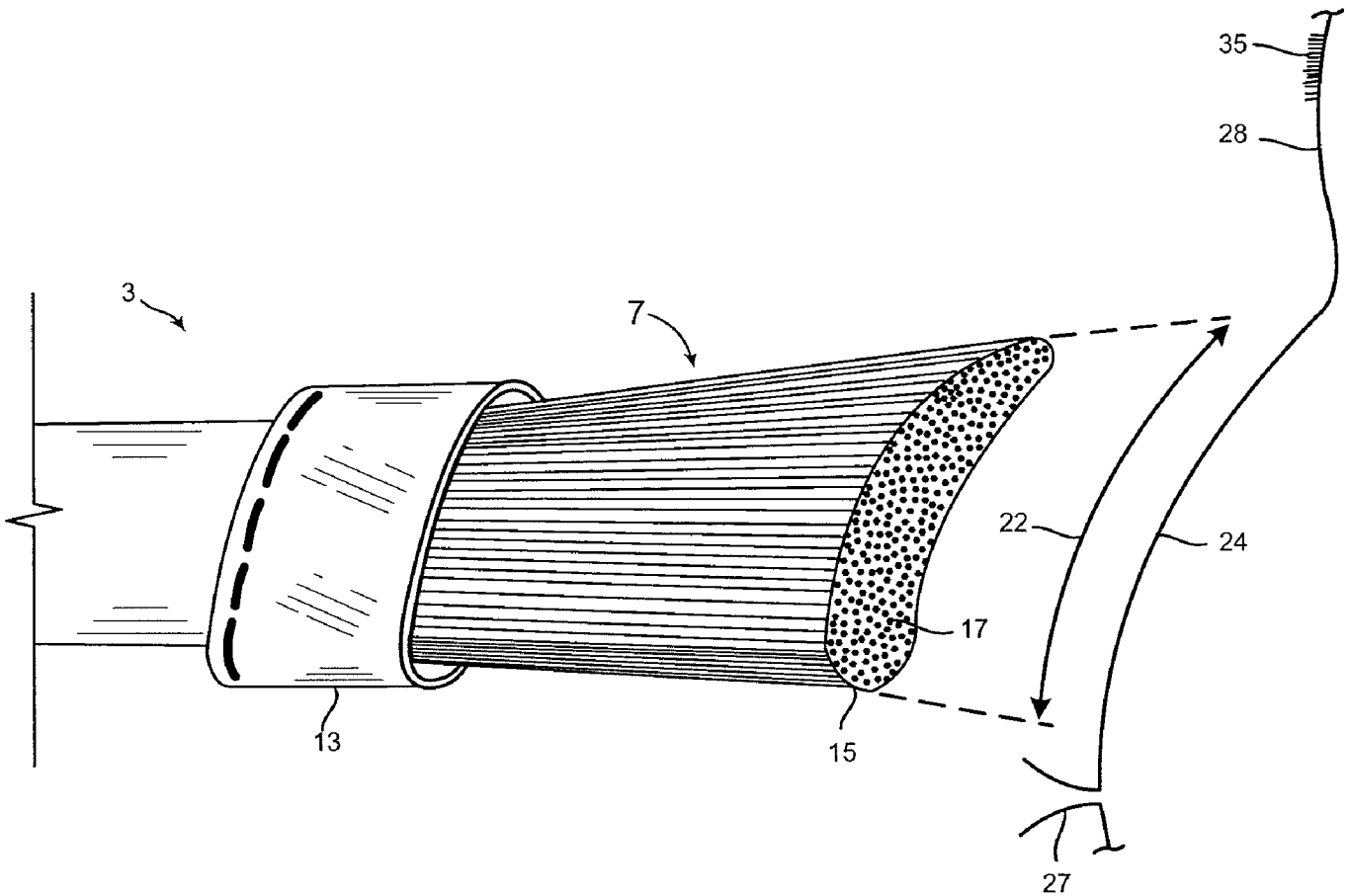
FIG. 2 is a perspective view of the applicator of the invention illustrating how it applies eye shadow make-up to the eye region of the user.

The relationship between the shape and extent of the distal end 15 of the bundle of bristles 7 and the closed eye lid of a user is best seen in FIG. 2, where the distal end 17 of the bristle bundle 7 is illustrated adjacent to a schematic profile of the eye region 21 of a user. Here, it is evident that the concave shape 17 of the bristle bundle 7 is complementary in shape to a maximum length, vertically oriented arc 24 defined by a center longitudinal axis of the eye lid area 26 that terminates in eye lashes 27. In the preferred embodiment of the invention, the arcuate extent 22 of the concave shape 17 defined on the distal end 15 of the bristle bundle 7 is about 50% that of the length of the vertically oriented arc 24. Such dimensioning advantageously allows the applicator 3 to uniformly apply eye shadow not only to the central eye lid area 26, but to the under brow area 28 and corners of the eye lid area.

Figure 3:
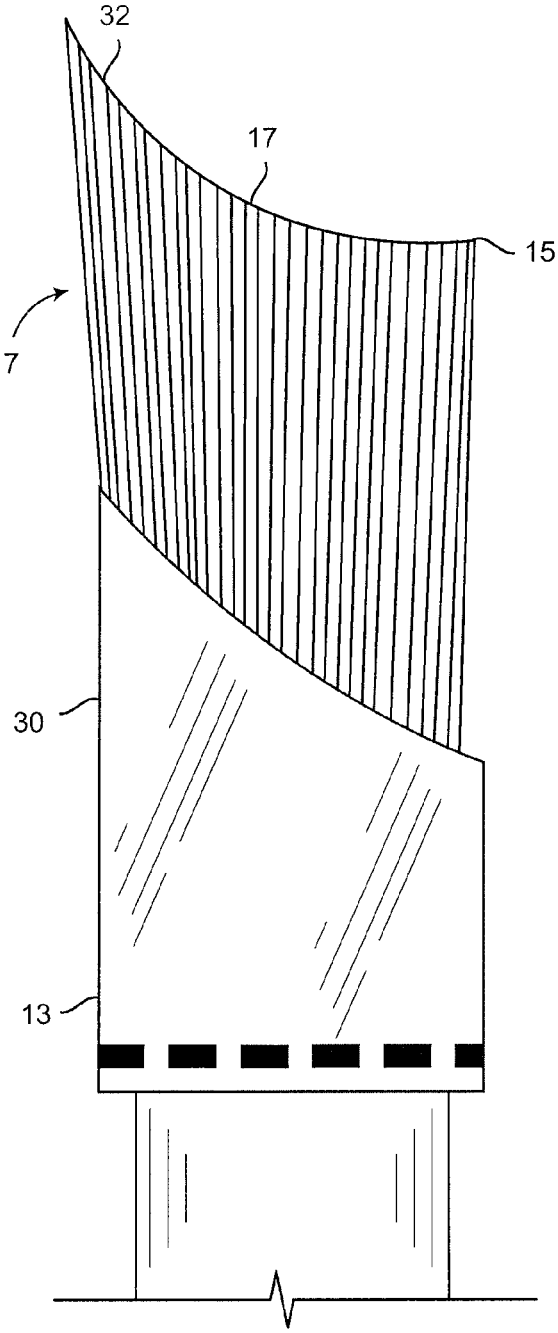
FIG. 3 is a side view of the applicator of the invention, illustrating an alternative collar member used for stiffening the bristles on one end of the brush.
Figure 4:
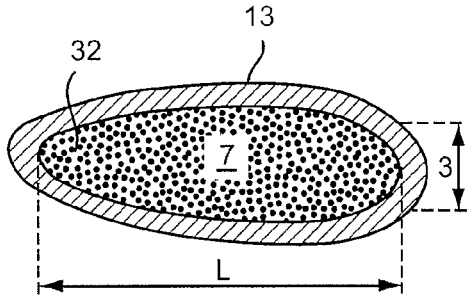
FIG. 4 is a front view of the applicator illustrated in FIG. 3.

With reference now to FIGS. 3 and 4, the collar member 13 may optionally have a protrusion 30 in order to stiffen the bristles extending out of one end 32 of the applicator 3. As is evident in FIGS. 1-3, while the convex profile 17 of the bristle bundle 7 is generally arcuate in shape, the actuate shape 17 is not symmetrical about a central axis of the applicator 3, but rather is obliquely disposed such that the distal end 15 assumes a shape somewhat like an old-fashioned fountain pen, with one pointed end of the bristles 32 extending out farther than the opposite end 34 of the bristle bundle 7. The collar protrusion 30 stiffens the bristles extending out from the pointed end 32 by cantilevering the bristles in this region a farther distance from the collar 13. Such stiffening, in turn, advantageously allows the user of the applicator 3 to use the pointed end 32 to accurately and uniformly apply eye shadow to the smaller regions of the eye area 26, such as the corners of the eye lids (not shown), and the areas immediately above the eye lashes 27 and immediately below the brows 35 of the user.

As is best seen with respect to FIG. 4, the length L of the distal end 15 of the bristle bundle 7 is preferably approximately four times the width W of the bundle 7. Such dimensioning strikes a proper balance between the ability of the distal end 15 of the applicator 3 to carry a supply of eye shadow from the pad 5 while maintaining an ability to apply such eye shadow accurately along the previously described, smaller regions of the eye area 21.

Figure 5:
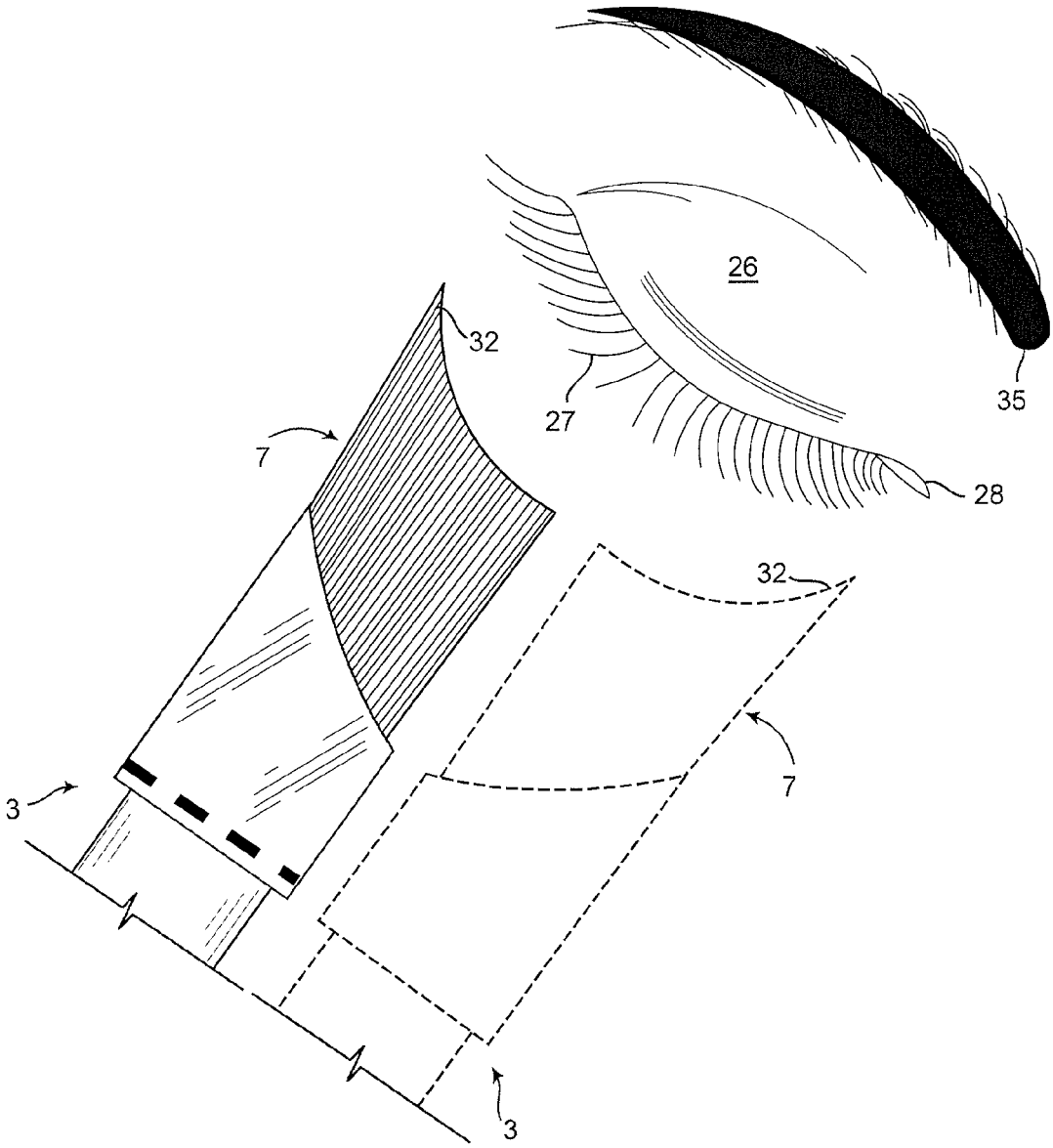
FIG. 5 illustrates the method of the invention wherein the applicator is flipped 180° incident to applying eye shadow make-up to the eye region of a user.

FIG. 5 illustrates the method of the invention, wherein the applicator 3 is maintained in a vertically oriented, upright position to apply eye shadow to the largest portion of the eye lid area 26 of the user, but then is rotated 180° (as indicated in phantom) in order to accurately apply eye shadow to the lower region of the eye lid just above the eye lash 27. The same, inverted orientation of the applicator 3 should be maintained when the user applies eye shadow in the under brow area 28.

The bristles constituting the bristle bundle 7 may be any one of the type commonly used in make up brushes, including artificial fibers such as nylon, or natural fibers such as camel or other animal hair. Additionally, the eye shadow make-up constituting the convex pad 5 of the system 1 may be any one of a number of commercially available eye shadow make-up as the invention resides in the convex shape of the make-up pad 5, in combination with the concave, complementary shape 17 of the applicator 3 and not in the composition of the eye shadow make-up itself.

While this invention has been described with respect to a preferred embodiment, various additions, modifications, and variations will become evident to persons skilled in the markup arts. All such additions, modifications, and variations are intended to fall within the scope of this invention, which is limited only by the appended claims and equivalents thereto.

What is claimed is:

1. An eye shadow applicator, comprising:

a bundle of bristles aligned in parallel along an axis and having a proximal end secured to a handle by a surrounding collar member and a distal end having a concave, arcuate shape with respect to a length of the bundle of bristles that is orthogonal to said parallel axis of the bristle bundle, said concave shape being substantially complementary to a maximum length vertically oriented arc defined by a closed eyelid, and wherein said concave, arcuate shape is asymmetrical such that one end of said bristle bundle is longer than an opposite end with respect to the parallel axis of the bristle bundle, and wherein said longer end includes a tapered end means for applying eye shadow to corners of a closed eyelid, wherein said collar member surrounding said proximal end of said bristle bundle includes a collar protrusion that stiffens the longer end of the bristle bundle.

2. An eye shadow applicator, comprising:

a bundle of bristles aligned in parallel along an axis and having a proximal end secured to a handle by a surrounding collar member and a distal end having a concave, arcuate shape with respect to a length of the bundle of bristles that is orthogonal to said parallel axis of the bristle bundle, said concave shape being substantially complementary to a maximum length vertically oriented arc defined by a closed eyelid, and wherein said concave, arcuate shape is asymmetrical such that one end of said bristle bundle is longer than an opposite end with respect to the parallel axis of the bristle bundle, and wherein said longer end includes a tapered end means for applying eye shadow to corners of a closed eyelid, wherein a maximum width of said distal end is no more than one-quarter of the length of said distal end.

* * * * *